United States Patent [19]

Lerner

[11] 3,948,015

[45] Apr. 6, 1976

[54] PACKAGING SYSTEM

[75] Inventor: Bernard Lerner, Hudson, Ohio

[73] Assignee: Automated Packaging Systems, Inc., Twinsburg, Ohio

[22] Filed: Sept. 28, 1973

[21] Appl. No.: 401,600

Related U.S. Application Data

[60] Continuation-in-part of Ser. No. 139,453, May 3, 1971, Pat. No. 3,815,318, which is a division of Ser. No. 422,281, Dec. 6, 1973, and a continuation-in-part of Ser. No. 336,560, Feb. 28, 1973.

[52] U.S. Cl. ..... 53/22 B; 53/29; 53/63; 53/112 B; 53/187; 53/385

[51] Int. Cl.[2] ..... B65B 31/04; B65B 43/32

[58] Field of Search ..... 53/22 B, 29, 187, 385, 53/63, 112 B

[56] References Cited

UNITED STATES PATENTS

| | | | |
|---|---|---|---|
| 2,612,738 | 10/1952 | Salfisberg | 53/29 |
| 3,448,555 | 6/1969 | Shabram | 53/29 |
| 3,518,809 | 7/1970 | Ott | 53/112 A |
| 3,815,318 | 6/1974 | Lerner | 53/29 |

*Primary Examiner*—Travis S. McGehee
*Attorney, Agent, or Firm*—Watts, Hoffmann, Fisher & Heinke Co.

[57] ABSTRACT

A packaging system including novel and improved packaging apparatus, packaging webs, and packaging methods having particular utility in the packaging of powder, granular and other fluent materials. The improved apparatus includes a movable loading chute which extends into a bag positioned in a loading station to funnel materials into the bag. The loading chute is guided by a cam during extension into the bag to assure that it properly enters and opens the bag. The bag is only partially opened by the entering loading chute and a seal is formed between the bag and the chute to prevent the escape of powder, etc. around the chute.

The packaging system is operable with existing packaging webs and with an improved packaging web which is partially sealed to define a restricted fill opening. After the bag is filled, the seal is completed across the fill opening, preferably at a location spaced outwardly from the contents of the bag.

Other features, including a vacuum system for evacuating air from loaded bags, are disclosed together with packaging methods utilizing the improved apparatus and packaging webs.

43 Claims, 8 Drawing Figures

PACKAGING SYSTEM

CROSS REFERENCES TO RELATED PATENTS AND APPLICATIONS

Cross reference is made to the following patents and applications, the disclosures of which are all incorporated by reference:

The present application is a continuation-in-part of two copending applications, namely parent application Ser. No. 139,453 filed May 3, 1971 entitled PACKAGING METHOD AND APPARATUS issued June 11, 1974 as U.S. Pat. No. 3,815,318, a division of which was filed on Dec. 6, 1973 and bears Ser. No. 422,281, and a first continuation-in-part application of the same title, Ser. No. 336,560 filed Feb. 28, 1973. These applications will be referred to as the "Automatic Machine Patents."

FLEXIBLE CONTAINER STRIPS, U.S. Pat. No. 3,254,828 issued June 7, 1966 to Hershey Lerner. This patent will be referred to as the "Article Patent."

MECHANISM FOR AUTOMATICALLY FEEDING, LOADING AND SEALING BAGS, U.S. Pat. No. 3,477,196 issued Nov. 11, 1969 to Bernard Lerner. This patent will be referred to as the "Machine Patent."

ARTICLE HANDLING APPARATUS WITH AUTOMATIC CONTROLS FOR SUPPLY AND DISPENSER, U.S. Pat. No. 3,610,464 issued Oct. 5, 1971 to H. H. Loughry. This patent will be referred to as the "Dispenser Patent."

BACKGROUND OF THE INVENTION

1. FIELD OF THE INVENTION

The present invention relates to packaging and more particularly to an improved packaging system which is particularly well adapted to package granular, powder, or other fluent materials in bag-like containers.

2. PRIOR ART

The referenced Article, Machine and Automatic Machine Patents relate to the utilization of a packaging web comprising a chain of interconnected bags. The bags are each open on one face. The other face of each bag is connected to a contiguous bag along a performed line of weakness.

The Article Patent describes a simple mechanism for dispensing, opening and loading the interconnected bags. A coiled web of interconnected bags is positioned on a mandrel in a carton. A blower is coupled to the carton to provide a positive pressure with the carton. The bags are fed, closed end first, through a slot in the carton. As the bags emerge from the carton, they are inflated by a relatively gentle flow of air emitted from the slot due to the positive pressure in the carton. A product is inserted in the inflated bag. The operator then moves the web until the next bag emerges from the carton and inflates, and also separates the loaded bag for a sealing operation.

The Machine Patent describes a machine for dispensing, loading, sealing, and severing the bags in sequential automatic operations. In addition, the machine is adapted to be connected to automatic counting and dispensing equipment such as that disclosed in the Dispenser Patent so that products being packaged are all automatically measured and deposited in the bags as the bags are fed to a load station. The Machine Patent also describes a system for providing an interrupted heat seal line whereby heavily loaded bags are not so weakened during the heat sealing operation that they tear along the sealing line.

The Automatic Machine Patents describe novel packaging systems for opening, loading, closing, and sealing bag-like containers at a loading station. Relatively movable gripper and closure bars clamp a loaded container to isolate a region of the container from forces applied in separating the loaded container from a web, and/or the weight of the contents of the container. Since a region of the container is isolated from external forces, a first operation can be performed in the force isolated region while a second operation is concurrently carried on outside the isolated region. Typically, the container can be heat sealed in the isolated region while forces are applied outside the isolated region to separate the container from the remainder of the web.

The referenced Dispenser Patent describes a dispensing and counting system which operates to segregate a pre-selected number of articles and to dispense them for loading into a package. The apparatus described in this patent is typically used to dispense articles into the loading chute of such apparatuses as are described in the Automatic Machine Patents. The Dispenser Patent additionally describes gating circuitry for passing an electrical signal once it has dispensed a predetermined quantity of articles.

In operation, the apparatuses described in the Automatic Machine Patents feed a packaging web to position a container in registry with a loading station. The container is typically positioned vertically and suspended from above by virtue of its interconnection along a preformed line of weakness with the remainder of the web. The bottom of the container is closed by a heat seal. The top of the container is opened by a blast of air as the container enters the loading station. A stationary loading chute positioned above the loading station is used to direct materials into the open top of the container.

Such packaging systems have prinicpally been used in conjunction with the packaging of various types of solid articles. The apparatuses have not addressed themselves to the problem of packaging powdered, granular, and other fluent materials of the type which may escape or spill if not adequately confined.

SUMMARY OF THE INVENTION

The present invention provides an improved packaging system which is particularly well adapted for use in packaging powdered, granular and other fluent materials.

In accordance with one aspect of the present invention, the packaging machines described in the Automatic Machine Patents are modified to include a movable loading chute which is extensible into a container positioned in the loading station. The container is not fully opened across its width but rather is opened only to the extent required to admit the loading chute. In effect the container forms a seal with the loading chute to prevent the escape of materials being packaged.

Bag opening is preferably effected somewhat differently than occurrs with the apparatuses of the Automatic Machine Patents. The blower air flow system used in these apparatuses is eliminated, and only a high velocity burst of air is used to partially centrally open a container positioned in the loading station. Once the container has been partially opened, a funnel-shaped loading chute is moved along a cam controlled path into the container opening. As the chute descends into the container, it preferably opens the container still further, thereby assuring that the container opening engages the chute and seals itself around the chute. The chute can also descend until its tapered configuration effects a seal with the container opening thereby obviating the need to further open the container.

This system of only partially opening the container to the degree necessary has several advantages over prior art systems which employed fully open containers:

1. The escape of powder materials through the container opening is prevented, thereby minimizing loss of materials being packaged and preventing their contaminating the area around the packaging apparatus, the packaging apparatus itself, and the region of the container in which a seal is to be subsequently formed;

2. Since the containers need be opened only partially across their width, a stronger packaging web can be formed with both sides of each container connected to adjacent containers by preformed lines of weakness. This added web strength can result in improved web stability for feeding;

3. The strength of the connection between the container being loaded and the remainder of its supporting web is maximized as the open container face is torn away from the remainder of the web only where necessary to admit the loading chute into the container; and 4. The restricted fill opening permits a flatter bag seal to be formed than would occur if the bag were fully opened across its width. Fully opened bags tend to sag as opposite faces are brought into registry for sealing. The smaller the opening, the less the sag.

A significant feature of the mating seal-like-engagement achieved between the loading chute and a container being loaded is that it keeps powder contamination out of the container region where a container seal will subsequently be formed. The funnel-shape of the loading chute assures that the container will form a seal around the chute opens the container.

A sensor is carried on the loading chute to sense proper extension of the chute into a container positioned at the loading station. The sensor preferably includes an electrical contact which normally engages the outer surface of the chute. When the chute properly extends into a container, portions of the container extend between the contact and the chute thereby interrupting the electrical connection between the chute and the contact. The chute is grounded and the interrupted ground circuit is used to provide a signal indicative of when the chute and a container are positioned in readiness for a dispensing operation.

Dispensers of various commercially available types can be used to dispense materials into the loading chute. One dispenser which has been used in successful experiments with the apparatus of the present invention is described in the Dispenser Patent. Most such commercially available dispensers include circuitry which is operative to effect dispensing in response to receipt of a signal, and which emits or gates a signal when dispensing is completed.

The apparatus of the present invention includes circuitry interconnecting such a dispensing apparatus and the chute carried sensor to provide a cycle of operation as follows:

1. The loading chute is normally in its down or "extended" position where it typically extends into a container positioned in the loading station;

2. When a signal is received from the dispenser indicating that dispensing has been completed, the chute is elevated to its up or "retracted" position which takes it out of the loaded container;

3. The container is then closed and sealed as described in the Automatic Machine Patents, and a new container is fed to the loading station;

4. The chute is then lowered into the new container. If the sensor carried on the chute senses proper extension of the chute into the container, the dispenser is signaled to dispense, whereafter the cycle is repeated. If improper engagement should be detected, the dispensing step is by-passed and the machine recycles.

The improved packaging apparatus can be equipped with a vacuum system for evacuating air from loaded containers prior to sealing. This can be accomplished by providing a vacuum evacuation conduit in the loading chute to draw air out of the upper region of a loaded container before the chute retracts. It can also be accomplished by connecting the loading chute itself to a vacuum evacuation system which draws air out of the chute and out of the top of a container once the container has been loaded.

As has been mentioned, the apparatus of the present invention can be used with known packaging webs which are modified to decrease the size of the preformed fill opening. It can, in accordance with another feature of the present invention, also be used with a novel and improved packaging web which has a restricted fill opening defined by seals extending partially across the web. The seals preferably have end formations which extend in spaced, substantially parallel relationship to define the fill opening therebetween. These seal end formations are arranged to mate with the loading chute and serve to effect a seal around the chute.

The end formations preferably extend toward the preformed line of weakness which connects their respective container to the remainder of the web. This arrangement permits a loaded container to be sealed by a short seal extending between the end formations at a location spaced from the seals which close the remainder of the container end region.

Improved packaging methods are provided which utilize the apparatus of the present invention and which employ the improved packaging web. The preferred methods include the steps of positioning a container in a loading station, extending a loading chute into the container, filling the container by passing materials through the chute, retracting the chute, and sealing the container.

As will be apparent from the foregoing summary, it is a general object of the present invention to provide a novel and improved packaging system which is particularly well adapted for use with powdered, granular and other fluent materials.

Other objects and a fuller understanding of the invention may be had by referring to the following description and claims taken in conjunction with the accompanying drawings.

DESCRIPTION OF THE PREFERRED EMBODIMENT

Figure 1:
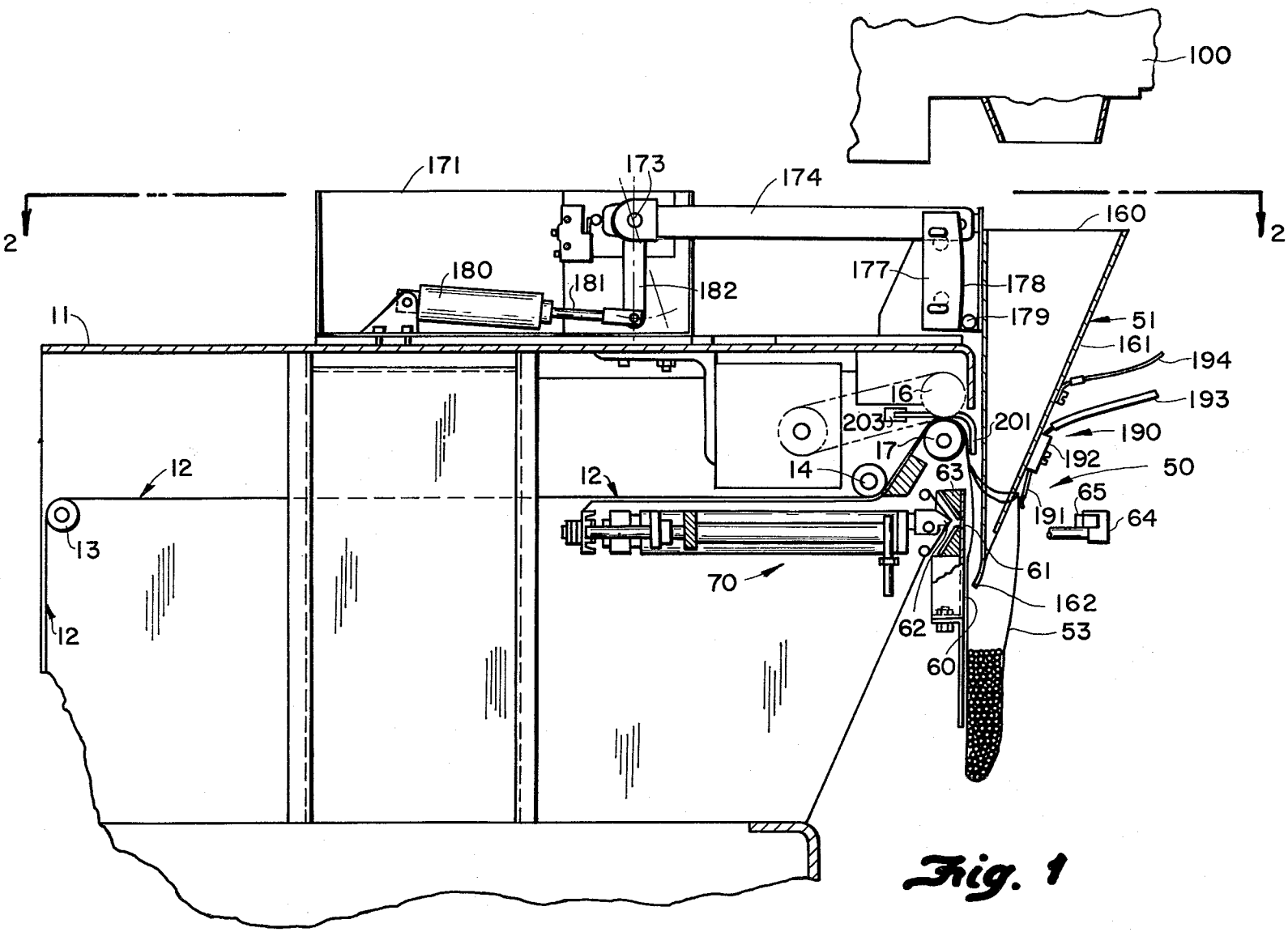
FIG. 1 is a schematic cross-sectional view of a packaging apparatus embodying certain aspects of the present invention with its movable loading chute in a filling position.

Referring to FIG. 1, a packaging system is shown including a packaging machine 10, a packaging web 12, and a dispensing apparatus 100. The machine 10 is of the general type described in the Automatic Machine Patents. The packaging web 12 is preferably of the general type described in the referenced Article Patent. The dispensing apparatus 100 is of a commercially available type, typically as described in the referenced Dispenser Patent. Since the disclosures of these patents and applications are incorporated herein by reference, the machine 10, the web 12 and the dispenser 100 will be described only in summary with emphasis on improvements which embody certain aspects of the present invention.

The machine 10 includes an upstanding cabinet 11 which journals a pair of idler rolls 13, 14 and a pair of feed rolls 16, 17. The rolls 13, 14, 16, 17 define a feed path for the packaging web 12 from a storage region (not shown) in the lower portion of the cabinet 11 to a loading station 50.

The upper feed roll 16 is motor driven and serves to position a container 53 formed on the web 12 in registry with the loading station 50. The feed rolls 16, 17 grip the web securely and hold the web 12 in place once the container 53 is registered in the loading station 50.

Once the container 53 reaches the loading station 50, it is opened. Materials to be packaged are discharged through a loading chute 51 into the container 53. As will be explained, the container 53 is opened and loaded somewhat differently than is described in the Automatic Machine Patents.

After the container 53 is loaded, a movably mounted closure bar 64 carrying a resilient pad 65 moves toward the container 53 to close the open upper end of the container, press it through a slot 61 formed in a guard plate 60, and bring it into engagement with a gripper bar assembly 63 and a heater bar 62. The closure bar 64, the gripper bar assembly 63, and the heater bar 62 cooperate to simultaneously close, grip, and seal the loaded container 53.

The closure bar 64, the gripper bar 63, and the heater bar 62 from part of a movably mounted assembly 70. The assembly 70 is movable, as described in detail in the Automatic Machine Patents, to tear the container 53 from the remainder of the web 12 along a preformed line of weakness. This tear-off operation is effected while the container 53 is gripped between the closure bar 64 and the gripper assembly 63.

In accordance with one aspect of the present invention, the loading chute 51 is modified from that described in the Automatic Machine Patent, and is mounted for movement toward and away from a container 53 positioned in the loading station. The modified loading chute 51 has a funnel-like configuration including an enlarged open top portion 160, a tapered intermediate portion 161, and an open bottom portion terminating in an inturned depending lip 162.

Figure 3:
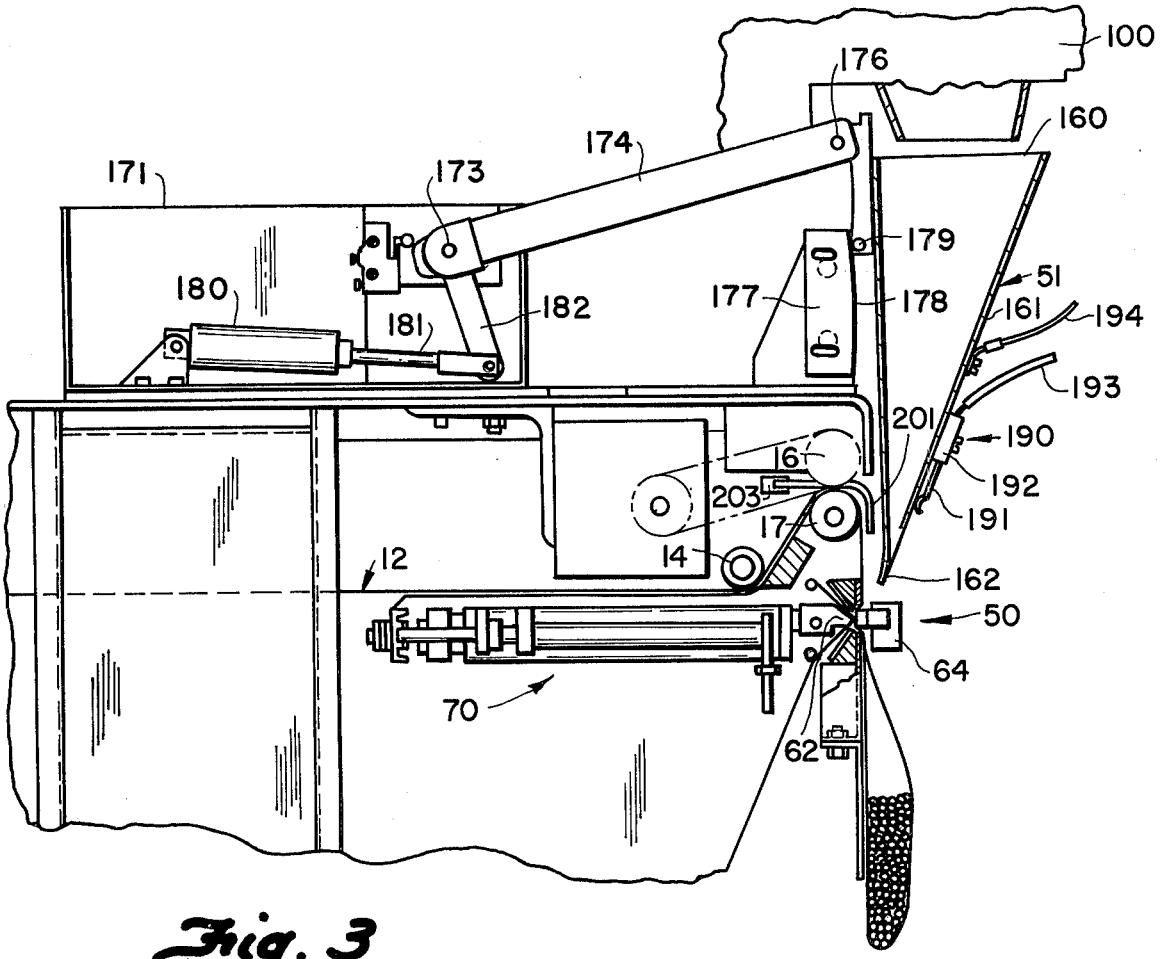
FIG. 3 is a view similar to FIG. 1, showing a portion of the packaging apparatus with the loading chute in a retracted position.

An operating mechanism 170 is provided atop the cabinet 11 to movably support the loading chute 51. The operating mechanism 170 includes an upstanding housing assembly 171, which, when viewed from above as shown in FIG. 3, has a generally T-shaped configuration. A pair of ball bearings 172 are supported by the housing 171. A shaft 173 journaled for rotation by the bearings 172. A pair of arms 174 are secured to opposite end regions of the shaft 173. A mounting bracket 175 is pivotally connected to the arms 174 by pins 176. The loading chute 51 is rigidly coupled to the mounting plate 175.

A cam member 177 defining a curved cam surface 178 is provided near the mounting plate 175. A cam follower 179 is carried on the mounting plate 175 and follows the contour of the cam surface 178 to guide the loading chute 51 along a controlled curved path of movement for introducing the lip 162 into the container 53.

Figure 2:
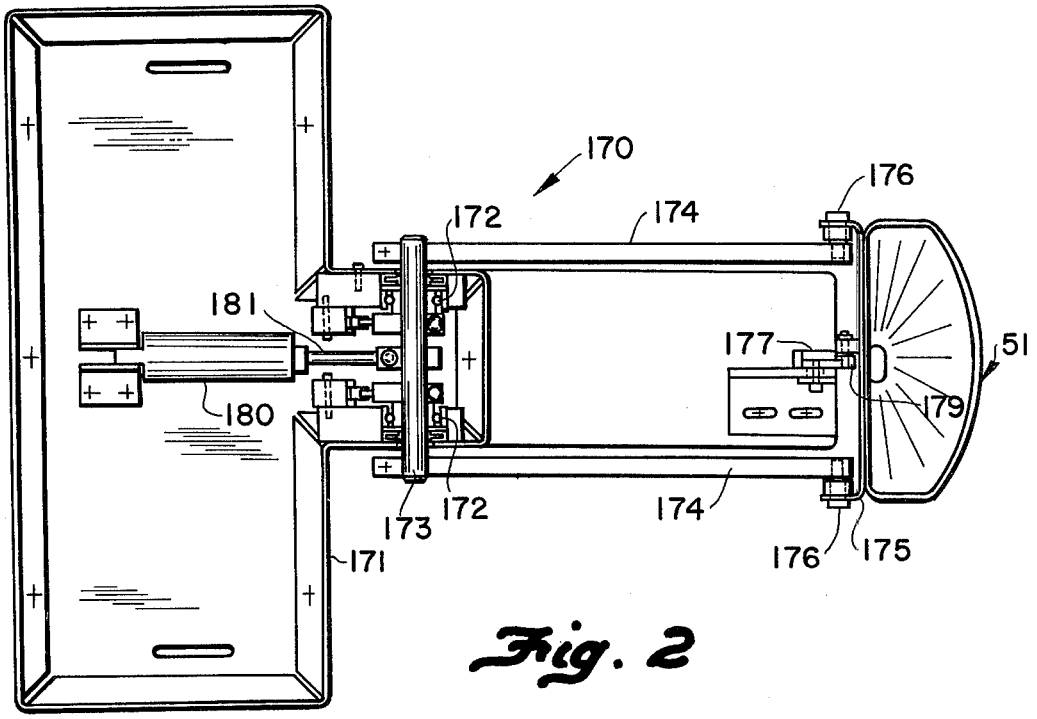
FIG. 2 is a top plan view as seen from the plane indicated by the line 2—2 in FIG. 1.

The loading chute 51 is normally positioned in its extended or filling position as shown in FIGS. 1, 2. A pneumatic cylinder 180 is positioned in the housing 171 for elevating the loading chute 51 to its retracted position, as shown in FIG. 3. The pneumatic cylinder 180 has a piston rod 181 which couples with a lever 182 secured to the shaft 173. When the piston rod 181 extends as shown in FIG. 3, the shaft 173 together with the arms 174 and the mounting bracket 175 pivot upwardly to raise the loading chute 151.

A sensor 190 is provided on the loading chute 51 to sense when the loading chute 51 has properly extended into the container 53. The sensor 190 includes a resilient electrically conductive feeler 191 supported at one end by an electrically insulative block 192. The feeler 191 depends from the block 192 and normally contacts the tapered intermediate portion 161 of the loading chute 51. An insulated electrical wire 193 connects with the feeler contact 191. Another electrically insulated wire 194 connects with the intermediate region 161 of the loading chute 51.

Figure 4:
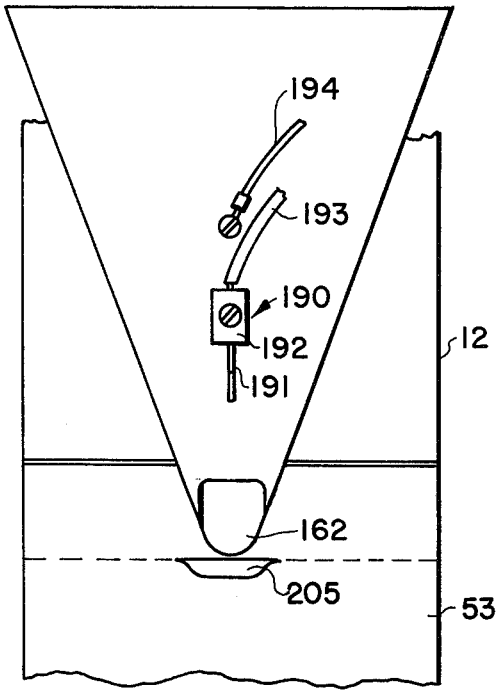
FIG. 4 is a front elevational view of the loading chute in a retracted position.
Figure 5:
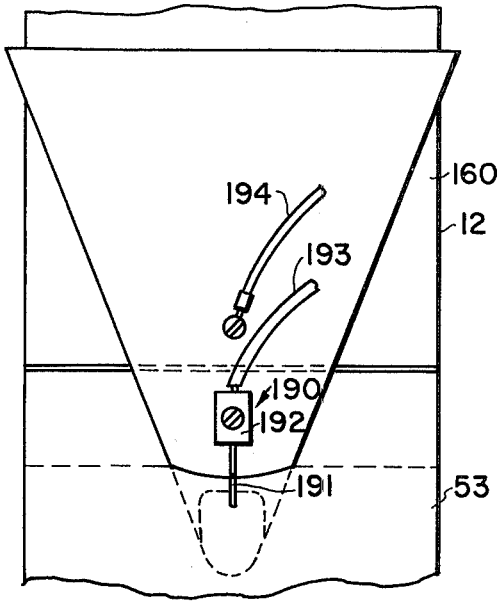
FIG. 5 is a view similar to FIG. 4 with the loading chute in a filling position.

When the loading chute 51 is in its retracted position, as shown in FIGS. 3, 4 the feeler 191 makes electrical contact with the loading chute 51 and completes a low voltage electrical circuit between the wires 193, 194. Typically, the wire 194 is connected to ground, and the wire 193 provides an interrupted ground circuit as controlled by contact between the electrical feeler 191 and the loading chute 51. When the loading chute 51 moves to its extended position and properly extends into a container 53, as shown in FIGS. 1, 5 a portion of the container 53 extends between the feeler 191 and the loading chute 51 thereby interrupting the circuit between the wires 193, 194. The interruption of this circuit provides a signal indicative of when the loading chute 51 has properly extended into the container 53.

In accordance with another aspect of the present invention, the container 53 is not opened fully across the width of the web 12 prior to loading. The machines described in the Automatic Machine Patents utilize a gentle flow of air from a blower located in the cabinet 11 to open a container. In the preferred embodiment of the present invention, this blower has been eliminated.

The container 53 is partially opened at a location central to the web 12 by a brief high velocity burst of air delivered from a conduit 201. Such a conduit and an associated control valve 203, are described in the referenced copending continuation-in-part application.

The high velocity air flow from the conduit 201 opens the container 53 as shown at 205, in FIGS. 3, 4. The centrally located opening 205 is sufficiently large to receive the lip 162 of the loading chute 51 as the loading chute moves from its retracted position into the container 53. As the chute 51 enters the container 53, it tears the container 53 open to a degree needed to admit the central chute portion 161. In effect, the container 53 forms a seal around the chute 51 which will retain powder or other materials in the container 53.

Figure 8:
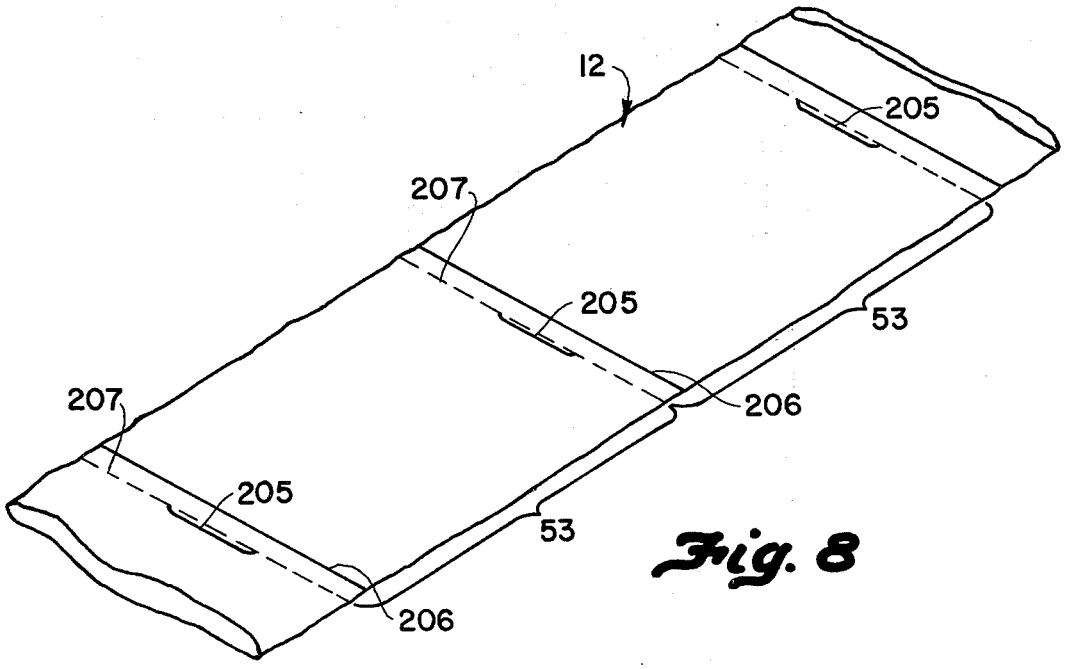

Referring to FIG. 8, the packaging web 12 comprises a series of serially connected preformed containers arranged in end-to-end relationship. Seals 206 extend across one end of each of the containers 53 defining a closed end region. The containers 53 are interconnected by preformed lines of weakness 207. The fill openings 205 are formed in one side of the containers 53 along a limited central region of the preformed lines of weakness 207.

Figure 6:
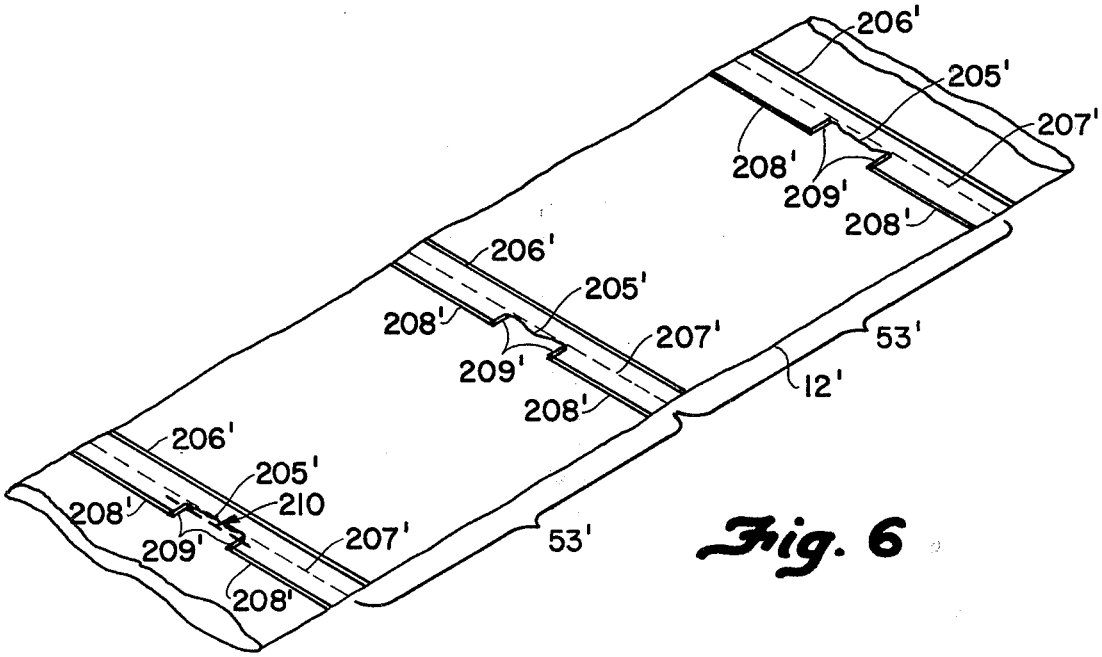
FIGS. 6 and 8 are perspective views of different packaging web embodiments which can be used with the packaging system of the present invention.

An alternate web embodiment which can be used with the packaging machine of the present invention is shown in FIG. 6 at 12'. A packaging web 12' is identical to the packaging web 12 with the exception that auxiliary seals 208' extend along, but are spaced from, the preformed lines of weakness 207'. The auxiliary seals 208' have end portions 209' which define the fill opening 205'. The end portions 209' extend longitudinally of the web 12' toward the preformed lines of weakness 207'.

When the loading chute 51 is inserted through the fill opening 205' it mates with the end formations 209' to establish a seal between the container 53' and the loading chute 51. When the container 53' has been loaded and the loading chute 51 removed, the container 53' can be sealed by a relatively short seal positioned as indicated by the dashed line 210 in FIG. 6, to extend between the end formations 209' at a location between the auxiliary seals 208' and the preformed line of weakness 207'. The location of the seal 210 at a position closer to the preformed line of weakness 207' is advantageous in that it minimizes the possibility of incomplete seal formation due to contamination by powder or other materials across the sealing surface.

Figure 7:
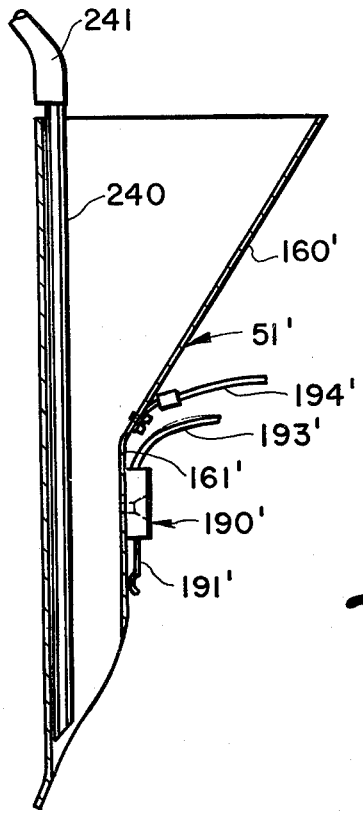
FIG. 7 is a cross-sectional view of an alternate loading chute embodiment including an air evacuation tube.

Referring to FIG. 7, it will be seen that an alternative chute embodiment 51' can be used in the apparatus of the present invention. Moreover, a vacuum system can be incorporated in the apparatus to effect evacuation of excess air from loaded containers. One way of incorporating such a vacuum evacuation system is to position a conduit 240 in the loading chute 51', as shown in FIG. 7. A flexible hose 241 communicating with the conduit 240 is adapted for connection to a vacuum evacuation source (not shown).

Another way of incorporating a vacuum evacuation system is to use the loading chute itself as the vacuum probe which extends into the container to evacuate air. Vacuum evacuation can be maintained in the container during seal formation by withdrawing the loading chute to a position just above the line of the heat seal.

The loading chute can also be used to effect nitrogen flushing of a container to replace oxygen in containers where the material being packaged is oxygen degradable.

In operation, once particles to be packaged have been dispensed into the container 53, the pneumatic cylinder 180 is energized to elevate the loading chute 51. The closure bar 64 is then moved toward the heater bar 62 and toward the gripper bar assembly 61, as described in the Automatic Machine Patents. The container 53 is closed and gripped between the closure bar 64 and the heater bar 62, as shown in FIG. 3. While the container 53 is so gripped, the assembly 70 pivots, as described in the Automatic Machine Patents, to sever the loaded container 53 from the remainder of the web. The closure bar 64 then opens to the position shown in FIG. 1, and a new container 53 is fed to the loading station.

As the new container 53 reaches the loading station, a burst of high velocity air is delivered from the conduit 201 to partially open the container, as shown in FIG. 4. The loading chute 51 is then released from its retracted position and travels downwardly as guided by the cam surface 178. The lip 162 projects inwardly of the container opening 205. As the loading chute 51 continues to descend, portions of the intermediate region 161 extend into the container 53 and tear the opening 205 open to a greater degree as shown in FIGS. 1, 5. If proper entry of the loading chute into the container 53 is effected, the sensor 190 will then permit the dispensing of materials from the dispenser 100, whereupon the cycle repeats.

Although the invention has been described in its preferred from with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed.

What is claimed is:

1. A packaging apparatus comprising:

a. means establishing a path for feeding a packaging web to a loading station for positioning a container forming portion of the web in the loading station;

b. loading means including a loading chute and drive means for moving said loading chute toward and away from a container portion positioned at the loading station for facilitating the loading of materials into such container portion;

c. closure means operative while such container portion is positioned at said loading station to close such container portion once it has been loaded and to grip such closed and loaded container portion to effectively isolate a selected section of such container portion from stress producing forces imposed on another section of such container portion; and d. operating means operative while such container portion is gripped by said closure means and while such container portion remains at said loading station to initiate the performance of an operation on such container portion which will impose stress prodducing forces on such another section, whereby such selected section remains effectively isolated from said forces.

2. The packaging apparatus of claim 1 wherein said drive means is operable to move said loading chute toward and away from a container portion positioned in the loading station between a filling position where said loading chute projects inwardly of such positioned container portion, and a retracted position where said loading chute is withdrawn from such container portion.

3. The packaging apparatus of claim 2 wherein said mechanism includes cam means for guiding said loading chute along a curved path for effecting entry into such positioned container portion.

4. The packaging apparatus of claim 2 wherein said drive means includes signal responsive operating means for noramlly maintaining said loading chute in one of said filling and retracted positions, said drive means being operative to move said loading chute to the other of said positions in response to receipt of a predetermined signal.

5. The packaging apparatus of claim 4 wherein:

a. dispensing means is provided for dispensing a predetermined quantity of materials into said loading chute;

b. said dispensing means is operative to provide said predetermined signal when a predetermined quantity of materials has been dispensed into said loading chute.

6. The packaging apparatus of claim 2 additionally including sensor means carried by said loading chute for detecting whether the loading chute is projecting inwardly of such positioned container portion.

7. The packaging apparatus of claim 6 wherein said sensor means includes a pair of normally contacting electrodes which are separated by the open end of said container portion to provide a variation in an electrical signal indicative of when said loading chute projects inwardly of such positioned container portion.

8. The packaging apparatus of claim 7 wherein a portion of said loading chute forms one of said electrodes and the other electrode includes a movable contact positioned to normally engage said loading chute portion.

9. The packaging apparatus of claim 7 additionally including dispensing means positioned to dispense a predetermined quantity of materials into said loading chute in response to a variation in said electrical signal indicating that said loading chute is projecting properly inwardly of a container.

10. In a packaging apparatus of the type including structure for feeding a packaging web along a feed path to position a container forming portion of the web at a loading station, the improvement of a system for loading, closing, sealing and initiating severance of a container portion while such container portion remains positioned at the loading station, comprising:

a. loading means including an extensible-retractible loading chute and drive means for moving the chute toward and away from a container portion positioned at the loading station to facilitate loading of materials into such container portion; and, b. operating means operable while such positioned container portion is at said loading station to close such container portion, to secure said closure, and to initiate severance of such container portion from the remainder of the web.

11. The packaging apparatus of claim 10 wherein said drive means is operative to move said chute toward and away from such positioned container portion along a curved path.

12. The packaging apparatus of claim 11 wherein said operating means includes cam means for guiding the movement of said loading chute along said curved path.

13. The packaging apparatus of claim 10 wherein:

a. said loading chute is mounted for movement in directions longitudinal of said feed path as said loading chute moves toward and away from such positioned container portion;

b. said operating means includes relatively movable members positioned on opposite sides of such positioned container portion and being movable relatively toward and away from each other in directions transverse to said feed path to close such positioned container portion and secure said closure; and, c. said operating means further includes means for moving said relatively movable members along said feed path after said members have gripped such positioned container portion to initiate severance of such gripped container portion from the remainder of the web.

14. A packaging apparatus comprising:

a. feeding means for feeding a packaging web to a loading station to position a container portion of the web at said loading station;

c. dispensing means operable to dispense a predetermined quantity of materials into said chute; and, d. sensor means carried by said loading chute for providing a variation in an electrical signal indicative of proper extension of said loading chute into said container portion, said dispenser means being responsive to such signal variation to dispense said predetermined quantity of materials through said chute into said container portion.

15. The apparatus of claim 14 wherein:

a. said dispensing means is operative to provide a predetermined signal at the completion of a dispensing operation; and, b. said loading means is responsive to said predetermined signal to retract said loading chute from such positioned container portion.

16. The apparatus of claim 15 additionally including relatively movable closure means positioned on opposite sides of such positioned container portion for closing such positioned container portion after said loading chute has retracted therefrom.

17. The apparatus of claim 16 wherein closure securing means is provided for securing the closure of such positioned container while such container portion remains at said loading station.

18. The apparatus of claim 17 additionally including means for moving said closure means to initiate tear-off of a closed loaded container portion gripped between said closure means.

19. A packaging system for packaging materials comprising:

a. a preformed packaging web having containers formed serially therealong and arranged end-to-end with a closed end region of one container interconnected by a transversely extending line of weakness to an open end region of an adjacent container, said open end regions each defining a fill opening having a width which is less than the width of its container;

b. a packaging apparatus including feeding means supporting such web and operative to feed such web to a loading station, and loading means including a loading chute extensible through the fill opening of a container positioned at the loading station to facilitate the loading of materials into such positioned container; and c. said loading chute being operative to engage the fill opening of such positioned container substantially to effect a seal circumferentially of the chute between such positioned container and the chute when the chute is extended through such fill opening.

20. The system of claim 19 wherein said chute has a tapered funnel-shaped configuration which is operative to further open the fill opening of such positioned container upon extension through such fill opening.

21. In a packaging apparatus of the type including structure for feeding a packaging container along a feed path to position the container in a loading station, the improvement of a container loading apparatus for loading materials into the container once it is at the loading station, comprising:

a. pneumatic means for directing a burst of air toward such positioned container to at least partially open such container in the region of a fill opening preformed in the container;

b. loading means including a loading chute having a generally funnel-shaped region insertable through the fill opening of such positioned container, and operating means movably mounting said loading chute to insert said region through such fill opening after such positioned container has been at least partially opened by said pneumatic means; and, c. said loading means additionally including drive means for directing said chute region along a curved path of entry into such positioned container to assure that said chute region properly extends through such fill opening to facilitate the loading of materials into such positioned container.

22. the apparatus of claim 21 wherein said operating means is operable to move said chute between an extended position where said chute region extends, through the fill opening of such positioned container and a retracted position where said chute region is withdrawn from such positioned container, said operating means being arranged to normally maintain said chute in one of said positions and being operable in response to receipt of a signal to move said chute to the others of said positions.

23. The apparatus of claim 22 wherein said drive means includes a cam structure operative during the movement of said chute from said retracted position to said extended position to guide said chute region along a curved path of movement for extension into such positioned container.

24. In a packaging apparatus of the type including structure for feeding a packaging container along a feed path to position the container at a loading station, the improvement of a container loading apparatus for loading materials into the container positioned at the loading station, comprising:

a. loading means including a loading chute of generally funnel-shaped cross section and operating means for extending said chute into a container positioned at the loading station and for withdrawing said chute therefrom;

b. vacuum evacuation means including a conduit adapted for connection to a vacuum evacuation apparatus and coupled to said chute for evacuating air from a loaded container prior to the withdrawal of said chute from such container; and, c. said operating means being operable to insert said funnel-shaped chute into such positioned container to a depth which will effect a seal between such container and said chute to prevent the escape of materials being loaded into such container and to facilitate the evacuation of air from such container.

25. A method of packaging comprising the steps of:

a. providing a structure defining a loading station;

b. feeding a packaging web along a feed path to a loading station to position a container forming portion of the web at the loading station;

c. inserting a loading chute into such positioned container and loading the container by passing materials through said loading chute and subsequently withdrawing said loading chute from such loaded container; and, d. while such container is at the loading station;

i. closing such loading container portion;

ii. gripping such closed loaded container portion to isolate effectively a region of said container portion from stress producing forces imposed on another region of said web; and iii. while such container portion is so gripped, initiating the performance of an operation on such container portion which will impose stress producing forces on said another region, whereby said isolated region remains effectively isolated from said forces.

26. A packaging method comprising the steps of:

a. feeding packaging material along a feed path to position a container forming portion of the web at a loading station;

b. partially opening a preformed filling opening of such a positioned container portion by directing a flow of high velocity air toward said fill opening to partially open said fill opening;

c. providing a loading chute having a funnel-shaped region near a smaller end thereof, and extending said region into the fill opening of such partially open container portion; to further open such fill opening;

d. subsequently loading a substance through said chute into such container portion; and e. withdrawing said chute and closing such loaded container portion.

27. The packaging method of claim 26 wherein the step of extending said chute out in such fashion as will cause container portions defining includes extending said funnel-shaped region sufficiently through such fill opening to effect a seal between such container portion and said chute to prevent the escape of such substance through said fill opening around said chute.

28. The packaging method of claim 26 wherein said step of extending said region includes moving said region along a curved path to assure proper insertion of said region into such positioned container portion.

29. The packaging method of claim 26 additionally including the step of withdrawing excess air from such loaded container portion prior to withdrawal of said chute.

30. A method of packaging comprising the steps of:

a. providing a container having a fill opening, and providing a loading chute which tapers from a cross-section having a lesser perimeter than that of said fill opening to a cross-section having a greater perimeter that that of said fill opening;

b. effecting relative movement of said chute and said container toward each other to extend said chute through said fill opening sufficiently to enlarge the perimeter of said fill opening and effect a substantial seal between said chute and said container, and, c. subsequently passing a substance through said chute and into said container to load said container.

31. The method of claim 30 additionally including the step of evacuating air from said container through said chute after such substantial seal is formed between said chute and said container.

32. The method of claim 30 additionally including the step of flushing said container with an inert gas introduced into said container through said loading chute.

33. A method of packaging, comprising the steps of:

a. positioning a collapsed, expansible container at a loading station, said container having a fill opening;

b. partially opening said container in the region of said fill opening;

c. extending a funnel shaped loading chute through said fill opening sufficiently to form a substantial seal between the chute and said container; and, d. passing a substance through the chute and into the container to load the container while such substantial seal substantially prevents the escape of such substance through said fill opening around said chute.

34. The method of claim 33 additionally including the step of evacuating air from said container through said chute after said seal is formed between said chute and said container.

35. The method of claim 33 additionally including the step of flushing said container with an inert gas introduced into said container through said loading chute.

36. A packaging system for loading materials into containers, comprising:

a. a preformed packaging web having containers formed serially therealong and arranged end-to-end with a closed end region of one container connected to the open end region of an adjacent container, said open end regions each underlying a fill opening formed between a pair of transversely extending seals; and, b. a packaging apparatus including:

i. feeding means for feeding said web along a path to successively position said containers at a loading station;

ii. loading means including a loading chute and drive means for moving said chute toward a container positioned in said loading station to extend a portion of said chute through the fill opening of such positioned container;

iii. said loading chute portion being tapered from a cross section having a perimeter less than that of said fill openings to a cross section having a perimeter greater than that of said fill openings;

iv. said drive means being operable to extend said loading chute portion sufficiently into such positioned container to effect a substantial seal between said loading chute and such container circumferentially of said loading chute.

37. The packaging system of claim 36 wherein:

a. said feeding means is operable to feed said web along said path with said containers substantially collapsed; and b. said packaging apparatus additionally includes means for partially opening a container positioned in said loading station to facilitate the extension of said loading chute portion into such positioned container.

38. The packaging system of claim 36 wherein said drive means is operative to extend said loading chute portion sufficiently into such positioned container to enlarge the perimeter of such fill opening.

39. The packaging system of claim 36 wherein said apparatus additionally includes means for evacuating air from such positioned container.

40. The packaging system of claim 36 additionally including means for flushing such positioned container with an inert gas.

41. The packaging system of claim 36 wherein:

a. said pairs of seals have seal portions which extend longitudinally of said web and define opposite sides of said fill openings; and b. said packaging apparatus additionally includes sealing means for forming a seal extending transversely between said seal portions on a container after such container has been loaded.

42. A method of packaging, comprising the steps of:

a. providing a container having a pair of overlying web portions secured together by a pair of spaced seals which define a fill opening therebetween;

b. providing a loading chute having a discharge portion which tapers from a cross section having a perimeter less than that of said fill opening to a cross section having a perimeter greater than that of said fill opening;

c. effecting relative movement of said container and said chute toward each other to extend said discharge portion through said fill opening and to stretch web portions near said fill opening around said discharge portion thereby forming a substantial seal between said container and said discharge portion;

d. passing a substance through said chute and into said container while said web portions near said discharge portion are substantially sealed around said discharge portion, whereby the escape of such substance through said fill opening around said discharge portion is inhibited.

e. withdrawing said chute from said container by moving said chute and said container relatively away from each other;

f. closing said fill opening by bringing said web portions near said opening into surface contact with each other; and g. securing such closure by forming another seal.

43. In a packaging apparatus of the type including a loading chute extensible into a container, the improvement of a sensor for providing a variation in an electrical signal indicative of a predetermined extension of the chute into the container, comprising:

a. a pair of normally contacting electrodes carried on said loading chute;

b. said electrodes being adapted to be separated by the extension therebetween of a portion of a container when said loading chute extends into such container to provide a variation in an electrical signal in response to the separation of said electrodes.

* * * * *